United States Patent [19]

Randar et al.

[11] 3,969,027

[45] July 13, 1976

[54] WRITING INSTRUMENT

[75] Inventors: George Andrew Randar, Canoga Park; Harris William Young, Oxnard, both of Calif.

[73] Assignee: The Gillette Company, Santa Monica, Calif.

[22] Filed: Apr. 3, 1975

[21] Appl. No.: 564,784

[52] U.S. Cl. ..... 401/199; 401/292

[51] Int. Cl.[2] ..... B43K 5/00; B43K 1/02

[58] Field of Search ..... 198/18, 199, 265, 292

[56] References Cited

UNITED STATES PATENTS

| | | | |
|---|---|---|---|
| 3,003,181 | 10/1961 | Rosenthal | 401/199 |
| 3,141,187 | 7/1964 | Simon et al. | 401/199 |
| 3,345,674 | 10/1967 | De Groft | 401/198 |
| 3,778,495 | 12/1973 | Wooley | 401/292 X |

FOREIGN PATENTS OR APPLICATIONS

| | | | |
|---|---|---|---|
| 1,485,772 | 5/1967 | France | 401/199 |

*Primary Examiner*—Lawrence Charles
*Attorney, Agent, or Firm*—Poms, Smith, Lande & Glenny

[57] ABSTRACT

Relates to a pocket-type writing instrument, employing an extruded rod-like writing element composed of a homogeneous thermoplastic composition having a formation of longitudinally extending ink-conducting channels around an axial channel, one end of said element constituting the writing point and the other being in contact with a body of ink, usually carried in an absorbent material contained in the barrel of the pen. Provides novel means for preventing axial displacement of the writing element without damage to or constriction of the ink channels therein and without the use of wire pins which may interfere with the ease of handling of the instrument.

1 Claim, 3 Drawing Figures

WRITING INSTRUMENT

It is important to properly and definitely position and hold the writing point of a writing instrument with respect to the barrel and particularly with respect to that frontal portion or area of the barrel which is normally grasped by the user. This grasping area has a definite relationship with the writing point and the user quickly becomes accustomed to this stable distance of the writing point with respect to the grasping area, whereby the use of the pen is facilitated. Metallic nibs of fountain pens are usually short and have a single short ink channel and such nibs abut fixed stops formed in portions of the pen removed from the reservoir portion. Such fountain pens employ rigid, transversely slotted feeders which furnish the ink from the reservoir to the nib. In the writing instrument of this invention, the writing element constitutes both the writing nib at one end and a contact area at the other end which extends into the main barrel portion of the instrument into contact with the body of ink therein. Porous points of marking and writing instruments are generally fairly long and some extend from a forward writing point or tip to a zone within the ink reservoir of the pen. Most of these are either fibrous or provided with a multiplicity of minute channels which must convey the ink from the reservoir to the point. The points tend to brush out under writing pressure and these minute channels are readily distorted, whereby the points lose their original ability to write with a fine line. Attempts to use fibrous writing element bonded with sufficient resin to impart rigidity are not safisfactory since the number of ink channels is materially reduced by the bonding resin and the size of the channels is also reduced, thereby impairing the rapid flow of ink to the tip during rapid writing. Moreover, a fibrous writing element rod can be forced rearwardly by writing pressure or force applied to the tip and the user often becomes dissatisfied with his writing instrument because of the changed spatial relationship of the tip to the grasping area to which he is accustomed and changes in writing characteristics due to fiber displacement. Attempts have been made to use constrictions around these fibrous rods in order to prevent rearward displacement of the writing tip, but such constructions normally reduce the cross sectional area of the original channels between fibers and their ability to feed ink in sufficient quantities during rapid writing to prevent starvation.

Although portions of elements of prior writing instruments have been connected by means of wire pins driven thereinto, the rear end of the pin often protrudes above the surface a slight amount, but one sufficient to be sensed by the finers and which is disturbing when it is evident in the finger grasping or locating zone. The present invention is directed to the use of a writing element which is made of a thermoplastic homogeneous composition and which contains minute channels carefully formed and arranged so as to supply ink to a curved or contoured writing tip, thereby permitting such writing tip to write in almost any position or angle with respect to the writing surface. A connecting pin cannot be successfully used in positioning this type of extruded small diameter writing element which contain 6, 8 or even 12 preformed radial ink channels, because the wire pin tends to disfigure, crush, break and clog the channels and impair their function and the utility of the entire writing instrument.

The improved construction and arrangement of the instant writing instrument permits the use of sophisticated forms and materials, and the maintenance of standards of perfection, accuracy, dependability and long life which not have been attained heretofore. Moreo ver, the improved construction and arrangement permits ready and economical manufacture.

An object of this invention is to obtain a writing instrument which can be manufactured economically from a minimum of parts and in which an efficient extruded writing element composed of a homogeneous thermoplastic composition is effectively utilized, the parts or elements being adapted for easy assembly and to function efficiently within a wide range of variations in duration and speed of writing.

Other objects and advantages will become evident from the following description. To facilitate understanding, reference will be had to an exemplary form of the invention, illustrated in the appended drawings in which.

Figure 1:
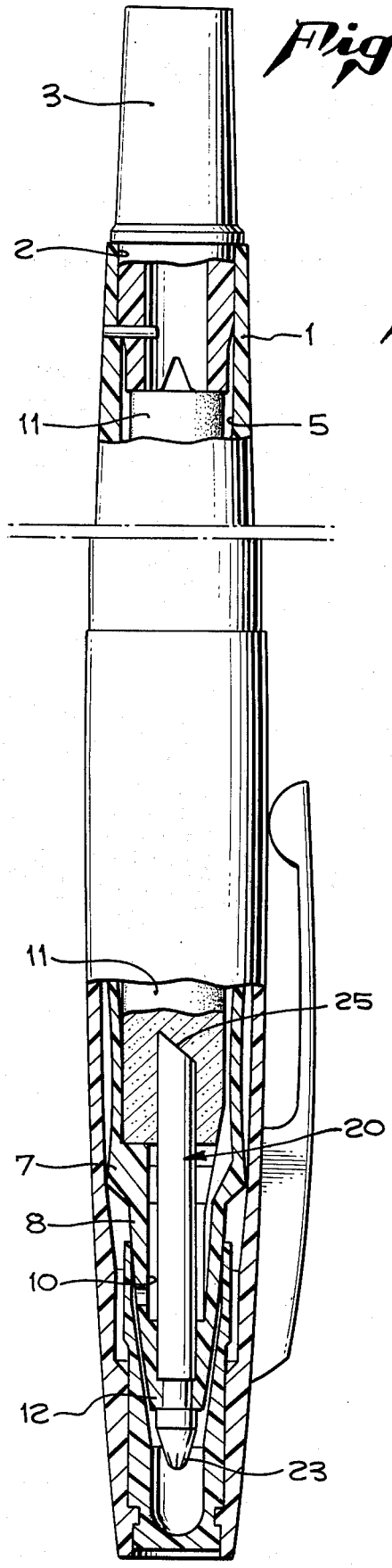
FIG. 1 is a side elevation partly in section and partly broken away, of a pocket-type writing instrument embodying the present construction.

As shown in FIG. 1 the instrument may include a main hollow barrel portion 1 which has an initially open rear end 2 which is stoppered or closed as an almost final step in the manufacture of the instrument by a rear end plug or plume 3 which is held in position by a pressed fit or a driven retainer wire or pin and retains an absorbent filler or reservoir 11 impregnated with ink, in the barrel chamber 5. The forward portion of the barrel is preferably of slightly smaller outside diameter than the main rear portion 1, and such frontal portion 7 may be elongated into a generally paraboloidal form indicated at 8 and is provided with an axial bore 10 in communication with the barrel chamber 5. The wall of the barrel 1 and the barrel portion 7–8 are made of a thermoplastic polymeric composition and the wall thickness adjacent the frontal entrance to the bore 10 is sufficiently thin and resilient to exhibit momentary elastic stretching under stress. The external surface 7 of the frontal portion may be considered a surface for positioning one or more fingers of the user of an instrument during writing therewith.

Figure 2:
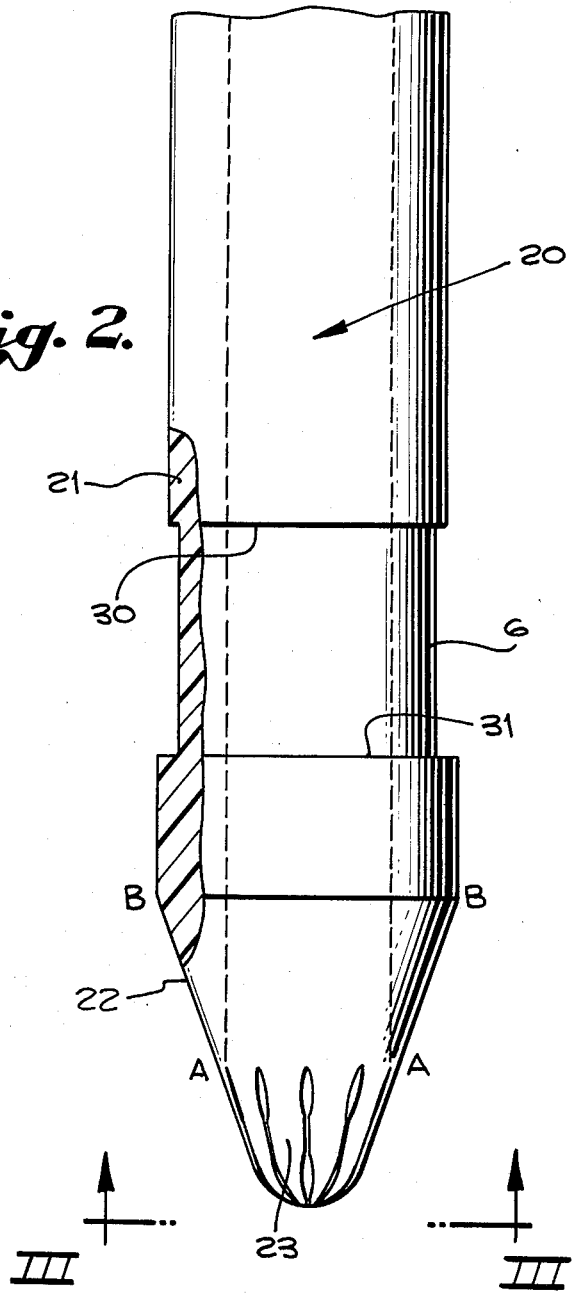
FIG. 2 is a somewhat enlarged side elevation of an extruded and contoured writing element composed of a homogeneous thermoplastic composition.
Figure 3:
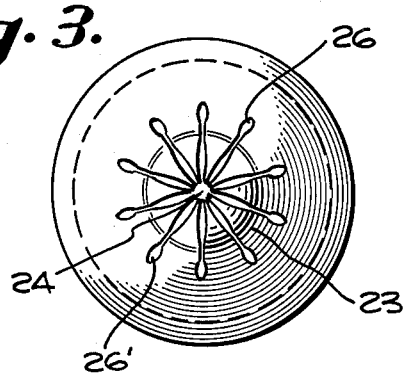
FIG. 3 is a transverse section (enlarged) taken through the frontal portion of the writing element, the section being taken along the plane III—III in FIG. 1.

The preferred elongated writing element generally indicated at 20 is shown in greater detail in FIGS. 2 and 3 and may be made by extrusion of a polymeric composition, in a continuous manner pursuant to U.S. Pat. No. 3,778,495 which is hereby incorporated by reference. As shown in FIGS. 2 and 3, the element 20 may comprise a cylindrical shank 21 having a frusto-conical frontal portion 22 blending into a contoured convex writing tip surface 23. The contoured convex tip surface 23 may be said to be forward of the plane AA and the frusto-conical portion 22 may be forward of the shank at about the plane BB. Extending throughout the length of the element 20 is an axial channel 24 for conveying a liquid (e.g. ink) and preferably has an average width or diameter of between about 2 and 5 mils and a plurality of channels extending radially therefrom each of such radial channels varying in width along its radial dimension and all such channels emerging on the inclined rear surface 25 of the shank to receive ink from the reservoir 11, and debouching or terminating in the contoured surface 23. Each of these radial channels 26, 26' and the like, may include a relatively wide channel portion with at least two adjoining narrow portions. By narrow portions, reference is made to those portions of the radial channels which are less than 1 mil wide (0.4 to 1 mil is a good range), whereas the wider channel portions may be between 1 and 3 mils wide and 2 to 4 mils in a radial direction. By providing radial channels which include both narrow and wide portions, the writing element 20 permits rapid flow of liquid ink therealong as well as interconnections of a capillary nature which, when the instrument is dropped or subjected to shock, prevent the ink in the adjacent larger channel portions from breaking or becoming discontinuous. The elemment 20 may contain six, eight, 10 or even 12 such radial channels. The array of radial channels is required to occupy an area embraced by a circle whose diameter is only about 60 percent to 75 percent of the shank diameter, since all of these radial channels must emanate or discharge upon the convex contoured surface 23 and normally the diameter of the zone in the plane AA is about 60 percent of the shank diameter.

Means are provided to positively position and hold the writing element 20 in the barrel with the rear face 25 in contact with the ink impregnated reservoir 11 and the convex contoured writing tip extending a desired predetermined distance beyond the frontal entrance to the bore 10. Such means comprise a circumferential groove 6 formed in the outer surface of the shank at a predetermined distance from the contoured surface 23, such circumferential groove 6 having oppositely facing spaced walls 30 and 31, and a depth insufficient to expose or intersect the outer terminals of the radial channels formed in the writing element.

The inner surface of the bore 10, adjacent the front entrance to said bore, is provided with inwardly extending locking shoulder means 12 adapted to extend into the groove in the shank, such shoulder means contacting the oppositely facing spaced walls of the groove. The shoulder means may be in the form of an inwardly extending ring, as shown, or the mechanical equivalent thereof.

It may be noted that the engaging faces and shoulders of the locking means need not exceed 10 mils in a radial direction to provide a positive positioning of the writing element resistant to pressures exceeding writing pressures generated by heavy writers.

The formation of the groove and its walls 30 and 31 may be by grinding at the same time that the tip is contoured and the rear end is formed by cutting the element from a rod.

As previously indicated, the frontal barrel portion 7–8 is preferably made of thermoplastic composition, such as a polypropylene, and is thin-walled. The writing element 20 can be readily inserted through the initially open front end of the barrel when it is forced into the bore 10, the enlarged shank portion to the rear of the groove momentarily expands the bore until the groove is in position to receive the locking shoulder means which snap into the groove. The porous reservoir may then be inserted into the barrel chamber 5, an ink charge injected thereinto, and the plume 3 pressed into place and pinned if desired. Such assembly operations may be economically formed by the use of apparatus of U.S. Pat No. 3,581,378. A cap with a clip is normally added to complete a pocket writing instrument of long life.

It is to be understood that the drawings herein referred to are not to scale, and that various changes may be made to facilitate insertion of the writing element from the front of the barrel if desired, or from the rear. All changes coming within the scope of the appended claims are embraced thereby.

We claim:

1. In a writing instrument having a main hollow barrel portion containing an absorbent ink-impregnated filler and a tapering frontal barrel portion providing an external elongated finger positioning surface area, the improvement comprising the provision of:

said tapering frontal barrel portion being so provided as to be resiliently deformable radially outwardly of an axial bore thereof;

locking shoulder means formed in said frontal barrel portion at the frontal entrance to said bore for presenting a pair of inwardly extending shoulders facing in opposing axial directions; and an elongated writing element being relatively nondeformable relative to said frontal barrel portion and composed of a homogenous thermoplastic polymeric composition, including a shank having a frusto-conical frontal portion terminating in a contoured writing tip surface, and a rear end surface, an axial channel for conveying liquid, a plurality of liquid conducting channels radially extending therefrom, all of said channels extending from said rear surface to and terminating within the contoured writing tip surface, and a circumferential groove with oppositely facing walls formed in the shank at a predetermined distance from the frusto-conical portion and contoured tip surface, said groove being adapted to receive the locking shoulder means when the frontal barrel portion is temporarily deformed radially outwardly by the element being inserted into the axial bore of the tapering frontal barrel portion until said shoulder means fits into said groove, the locking shoulder means being then retained in the groove by the resilience of the frontal barrel portion, a constrictive effect thereof being absorbed by a continuous layer of thermoplastic polymer composition over the array of radial liquid-conducting channels, the element being thereby restrained from axial displacement in said bore under shock and writing pressure without constriction or impairment of said channels or variation in relative spatial position of said contoured writing tip surface and finger positioning area.

* * * * *